US007964783B2

(12) United States Patent
Rosario et al.

(10) Patent No.: US 7,964,783 B2
(45) Date of Patent: Jun. 21, 2011

(54) SYSTEM AND METHOD FOR EVOLVING MUSIC TRACKS

(75) Inventors: Michael Rosario, Winter Park, FL (US); Kenneth O. Stanley, Orlando, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 297 days.

(21) Appl. No.: 12/131,396

(22) Filed: Jun. 2, 2008

(65) Prior Publication Data

US 2008/0295674 A1 Dec. 4, 2008

Related U.S. Application Data

(60) Provisional application No. 60/941,192, filed on May 31, 2007.

(51) Int. Cl.
*G10H 1/40* (2006.01)

(52) U.S. Cl. ..... 84/611; 84/609; 84/635; 84/649; 84/651; 84/667

(58) Field of Classification Search ..... None
See application file for complete search history.

(56) References Cited

U.S. PATENT DOCUMENTS

| | | | | |
|---|---|---|---|---|
| 5,138,928 | A * | 8/1992 | Nakajima et al. | 84/635 |
| 5,883,326 | A * | 3/1999 | Goodman et al. | 84/649 |
| 6,051,770 | A * | 4/2000 | Milburn et al. | 84/611 |
| 6,297,439 | B1 * | 10/2001 | Browne | 84/635 |
| 6,417,437 | B2 * | 7/2002 | Aoki | 84/611 |
| 7,065,416 | B2 * | 6/2006 | Weare et al. | 700/94 |
| 7,193,148 | B2 * | 3/2007 | Cremer et al. | 84/635 |
| 7,196,258 | B2 * | 3/2007 | Platt | 84/600 |
| 7,227,072 | B1 * | 6/2007 | Weare | 84/609 |
| 7,381,883 | B2 * | 6/2008 | Weare et al. | 84/668 |
| 2005/0092165 | A1 * | 5/2005 | Weare et al. | 84/668 |
| 2006/0266200 | A1 * | 11/2006 | Goodwin | 84/611 |
| 2007/0022867 | A1 * | 2/2007 | Yamashita | 84/612 |
| 2007/0074618 | A1 * | 4/2007 | Vergo | 84/612 |
| 2007/0199430 | A1 * | 8/2007 | Cremer et al. | 84/611 |
| 2008/0190271 | A1 * | 8/2008 | Taub et al. | 84/645 |
| 2008/0249982 | A1 * | 10/2008 | Lakowske | 707/3 |

OTHER PUBLICATIONS

Kenneth O. Stanley and Risto Mikkulainen, "Evolving Neural Networks Through Augmenting Topologies", The MIT Press Journals, vol. 10, No. 2, pp. 99-127, 2002.

Stanley, Kenneth O., "Compositional Pattern Producing Networks: A Novel Abstraction of Development," Appeared in Genetic Programming and Evolvable Machines, Special Issue on Developmental Systems, New York, NY: Springer, 2007, pp. 1-36.

(Continued)

*Primary Examiner* — Marlon T Fletcher
(74) *Attorney, Agent, or Firm* — Thomas, Kayden, Horstemeyer & Risley, LLP

(57) ABSTRACT

Systems and methods of evolving music tracks are disclosed. One example method providing a plurality of Artificial Neural Networks (ANNs). Each of the ANNs uses a time signature input. The method also includes producing a rhythm from each of the plurality of ANNs. The method also includes evolving a next generation of ANNs based upon a user selection of one of the plurality of rhythms and upon the previous generation of ANNs. An example system includes a plurality of Compositional Pattern Producing Networks (CPPNs). Each of the CPPNs uses a time signature input to produce a rhythm. The system also includes logic configured to receive a selection of one or more of the CPPN, and logic configured to generate at least one evolved CPPN based upon the selection.

20 Claims, 5 Drawing Sheets

OTHER PUBLICATIONS

Stanley, Kenneth O., "Exploiting Regularity Without Development," Appeared in Proceedings of the 2006 AAAI Fall Symposium on Developmental Systems, Menlo Park, CA: AAAI Press, 2006, pp. 1-8.

* cited by examiner

10

SYSTEM AND METHOD FOR EVOLVING MUSIC TRACKS

CROSS-REFERENCE TO RELATED APPLICATIONS

This application claims the benefit of U.S. Provisional Application No. 60/941,192, filed May 31, 2007, which is incorporated by reference herein in its entirety.

FIELD OF THE DISCLOSURE

This application relates generally to generating music tracks, and more specifically to generating music tracks using artificial neural networks.

BACKGROUND

Some computer-generated music uses interactive evolutionary computation (IEC), by which a computer generates a random initial set of music tracks, and then a human selects aesthetically pleasing tracks that are used to produce the next generation. However, even with human input for selecting the next generation, computer-generated music often sounds artificial and uninspired. Also, computer-generated music often lacks a global structure that holds together the entire song.

BRIEF SUMMARY

One example embodiment involves a method for generating rhythms. This method comprises the steps of: generating an initial population of Compositional Pattern Producing Networks (CPPNs) wherein each CPPN produces a rhythm output; receiving a selection of one of the rhythm outputs; and evolving a next generation of CPPNs based upon the selection.

Another example embodiments involves a system for generating rhythms. This system comprises a plurality of Compositional Pattern Producing Networks (CPPNs), each of the CPPNs using a time signature input to produce a rhythm; logic configured to receive a selection of one or more of the CPPNs; and logic configured to generate at least one evolved CPPN based upon the selection.

DETAILED DESCRIPTION

Music may be represented as a function of time. In this regard, where t=0 indicates the beginning of a musical composition and t=n indicates the end of a musical composition, there is a function f(t) that embodies a pattern equivalent to the musical composition itself. However, with respect to the musical composition, the function f(t) may be difficult to formulate. While it may be difficult to formulate a function f(t) indicative of the musical composition itself, the musical composition has recognizable structure, which varies symmetrically over time. For example, the time in measure increases from the start of the measure to the end of the measure then resets to zero for the next measure. Thus, a particular musical composition exhibits definable variables, such as time in measure ("m"), time in beat ("b"), and time in song ("t"), which can be viewed as a time signature. These variables may then be used as arguments to a function, e.g., g(m, b, t), which receives the variables as arguments at any given time and produces a note or a drum hit for the given time.

Over the period t=0 to t=n, these note or drum hit outputs comprise a rhythm exhibiting the structure of the time signature inputs. In this regard, the rhythm output produced by the function will move in accordance with the function input signals, i.e., the time in measure and the time in beat over the time period t=0 to t=n. Thus, g(m, b, t) will output a function of the musical composition structure, i.e., time in measure and time in beat, and the output will sound like rhythms indicative of the time structure.

The transformation function g(t) which generates a rhythm as a function of various inputs can be implemented by, or embodied in, an artificial neural network. Viewed another way, the artificial neural network encodes a rhythm. In some embodiments, a specific type of artificial neural network called a Compositional Pattern Producing Network (CPPN) is used. Although embodiments using CPPNs are discussed below, other embodiments uses different types of artificial neural networks are also contemplated.

The systems and methods disclosed herein generate an initial set of CPPNs which produce a rhythm output from a set of timing inputs. A user selects one or more CPPNs from the initial population, and the systems and methods evolve new CPNNs based on the user selections.

Figure 1:
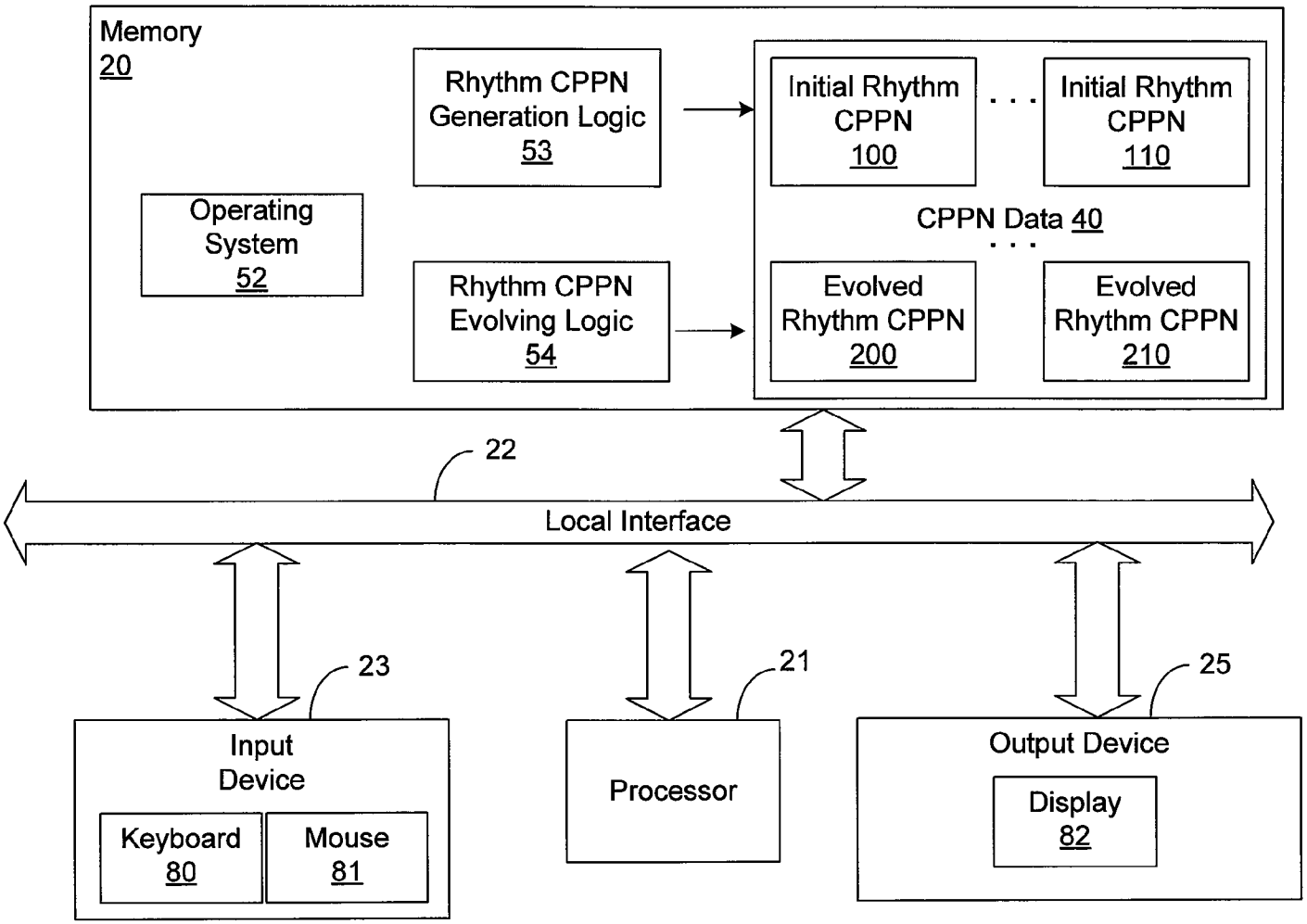
FIG. 1 is a block diagram depicting an example system for evolving a rhythm in accordance with various embodiments disclosed herein.

FIG. 1 illustrates an example rhythm-evolving system 10. As indicated in FIG. 1, the rhythm-evolving system 10 generally comprises a processor 21, memory 20, and one or more input/output (I/O) devices 23 and 25, respectively, each of which is connected to a local interface 22. The I/O devices 23 and 25 comprise those components with which a user can interact with the rhythm-evolving system 10, such as a display 82, keyboard 80, and a mouse 81, as well as the components that are used to facilitate connection of the computing device to other devices (e.g., serial, parallel, small computer system interface (SCSI), or universal serial bus (USB) connection ports).

Memory 20 stores various programs, in software and/or firmware, including an operating system (O/S) 52, rhythm CPPN generation logic 53, and rhythm evolving logic 54. The operating system 52 controls execution of other programs and provides scheduling, input-output control, file, data management, memory management, and communication control and related services. In addition, memory 20 stores CPPN data 40 comprising a plurality of initial rhythm CPPNs 100-110 and a plurality of evolved rhythm CPPN 200-210.

During operation, the rhythm CPPN generation logic 53 generates the plurality of initial rhythm CPPNs 100-110 that produce a plurality of respective rhythms, e.g., drum rhythms. In this regard, each CPPN 100-110 receives one or more inputs containing timing information (described further herein), and produces an output that is an audible representation of the rhythm embodied or encoded in the respective CPPNs 100-110.

Once the CPPNs 100-110 are generated, a program can query CPPN generation logic 53 to obtain a description of one or more of the initial CPPNs 100-110, where the CPPN description includes a description of the rhythm output. In some embodiments, the CPPN description also describes other aspects of the CPPN, including (for example) the input signal, the activation functions, etc. Using the CPPN description, the program can display one or more graphical representations of the rhythms embodied in the CPPNs 100-110 via the display 82. A graphical display of the rhythms embodied in the CPPNs is described further with reference to FIG. 3.

The graphical representations enable the user to visually inspect different characteristics of each of the rhythms embodied in the initial CPPNs 100-110. In addition and/or alternatively, the user can listen to each of the rhythms and audibly discern the different characteristics of the plurality of rhythms. The user then selects one or more rhythms exhibiting characteristics that the user desires in an ultimate rhythm selection.

After selection of one or more rhythms by the user, the rhythm CPPN evolving logic 54 generates a plurality of evolved CPPNs 200-210. In one embodiment, the CPPN evolving logic 54 generates the CPPNs 200-210 by employing a Neuroevolution of Augmenting Topologies (NEAT) algorithm. The NEAT algorithm is described in "Evolving Neural Networks through Augmenting Topologies," in the MIT Press Journals, Volume 10, Number 2 authored by K. O. Stanley and R. Mikkulainen, which is incorporated herein by reference. The NEAT algorithm and its application within the rhythm-evolving system 10 are described hereinafter with reference to FIGS. 2 and 3.

In employing NEAT to evolve the CPPNs 200-210, the CPPN evolving logic 54 may alter or combine one or more of the CPPNs 100-110. In this regard, the CPPN evolving logic 54 may mutate at least one of the CPPNs 100-110 or mate one or more of the CPPNs 100-110 based upon those selected by the user. The user may select, for example, CPPNs 100-105 as exhibiting characteristics desired in a rhythm by the user. With the selected CPPNs 100-105, the evolving logic 54 may select one or more of the CPPNs 100-105 selected to mate and/or mutate. Furthermore, the evolving logic 54 may apply speciation to the selected CPPNs 100-105 to form groups of like or similar CPPNs that the evolving logic 54 makes and/or mutates.

Once the evolving logic 54 mutates at least one CPPN 100-110 and/or mates at least two of the CPPNs 100-110, the evolving logic 54 stores the mutated and/or mated CPPNs 100-110 as evolved rhythm CPPNs 200-210. Once the evolving logic 54 generates one or more CPPNs 200-210, a program can query evolving logic 54 to obtain a description of the evolved CPPNs 200-210 to the user, and can generate a graphical representation of one or more of evolved CPPNs 200-210 (as described earlier in connection with CPPNs 100-110). Again, the user can select one or more of the rhythms embodied in the CPPNs 200-210 as desirable, and the evolving logic 54 performs mutation and mating operations on those CPPNs embodying those rhythms desired by the user. This process can continue over multiple generations until a rhythm is evolved that the user desires.

Figure 2A:
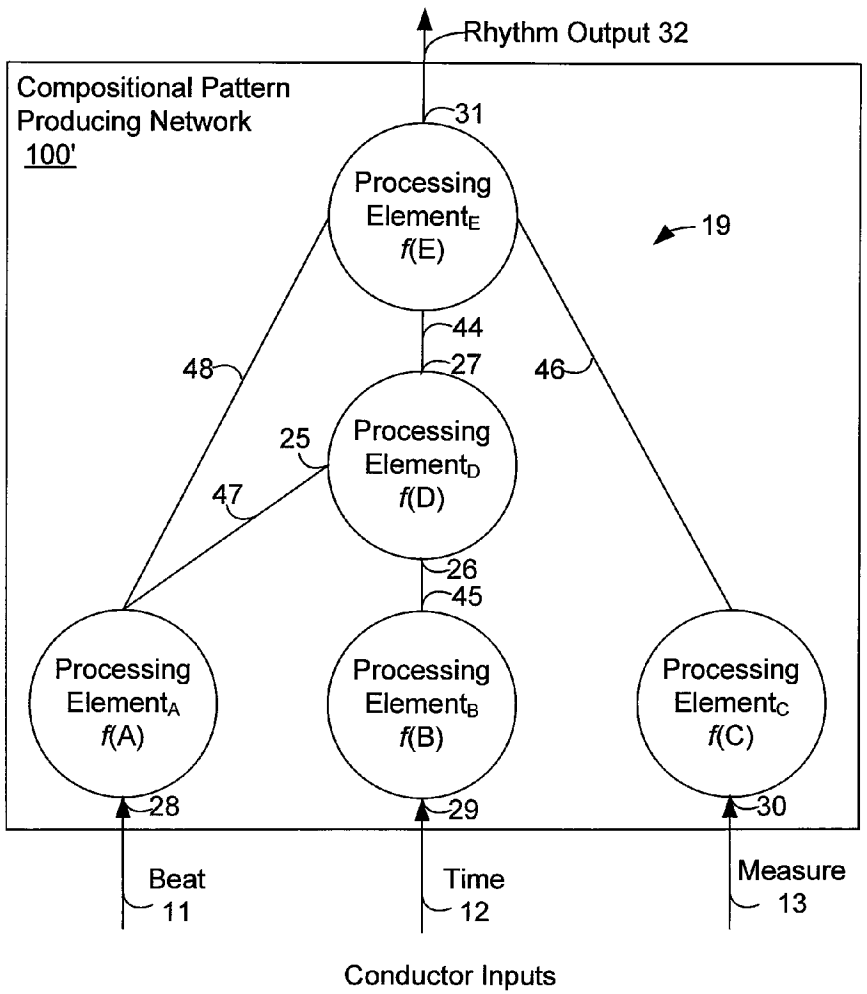
FIGS. 2A and 2B are diagrams depicting example Compositional Pattern Producing Network Artificial Neural Networks (CPPNs) generated and/or evolved by the system from FIG. 1.

FIG. 2A depicts an example CPPN 100' indicative of the CPPNs 100-110 or CPPNs 200-210. CPPN 100' exhibits an example topology 19 having a plurality of processing elements A-E. The processing elements A-E are positioned with respect to each other as described further herein, and the processing elements A-E are connected through multiple connections 44-48. CPPN 100' receives input signals 11-13 and each of the processing elements A-E performs a function f (A)-f (E), respectively, on its received input(s). Each processing element uses one of the input time signature inputs.

Each function f (A)-f (E) is referred to as an "activation function," which is a mathematical formula that transforms on input(s) of a processing element A-E into one or more output rhythm signals 32. Thus, each input signal 11-13 can be viewed as comprising a series of time steps, where at each time step the CPPN 100' transforms the combination of input time signature inputs 11-13 into one or more corresponding output rhythm signals 32, each of which represents a note or a drum hit for that time.

When associated with a particular percussion instrument (e.g., when a user makes the association via a user interface), a particular rhythm signal 32 indicates at what volume the instrument should be played for each time step. For ease of illustration, the example embodiment of FIG. 2 shows a single rhythm signal output 32, but other embodiments produce multiple rhythm output signals 32. In some embodiments, output rhythm signal 32 is converted to the MIDI format.

Figure 3:
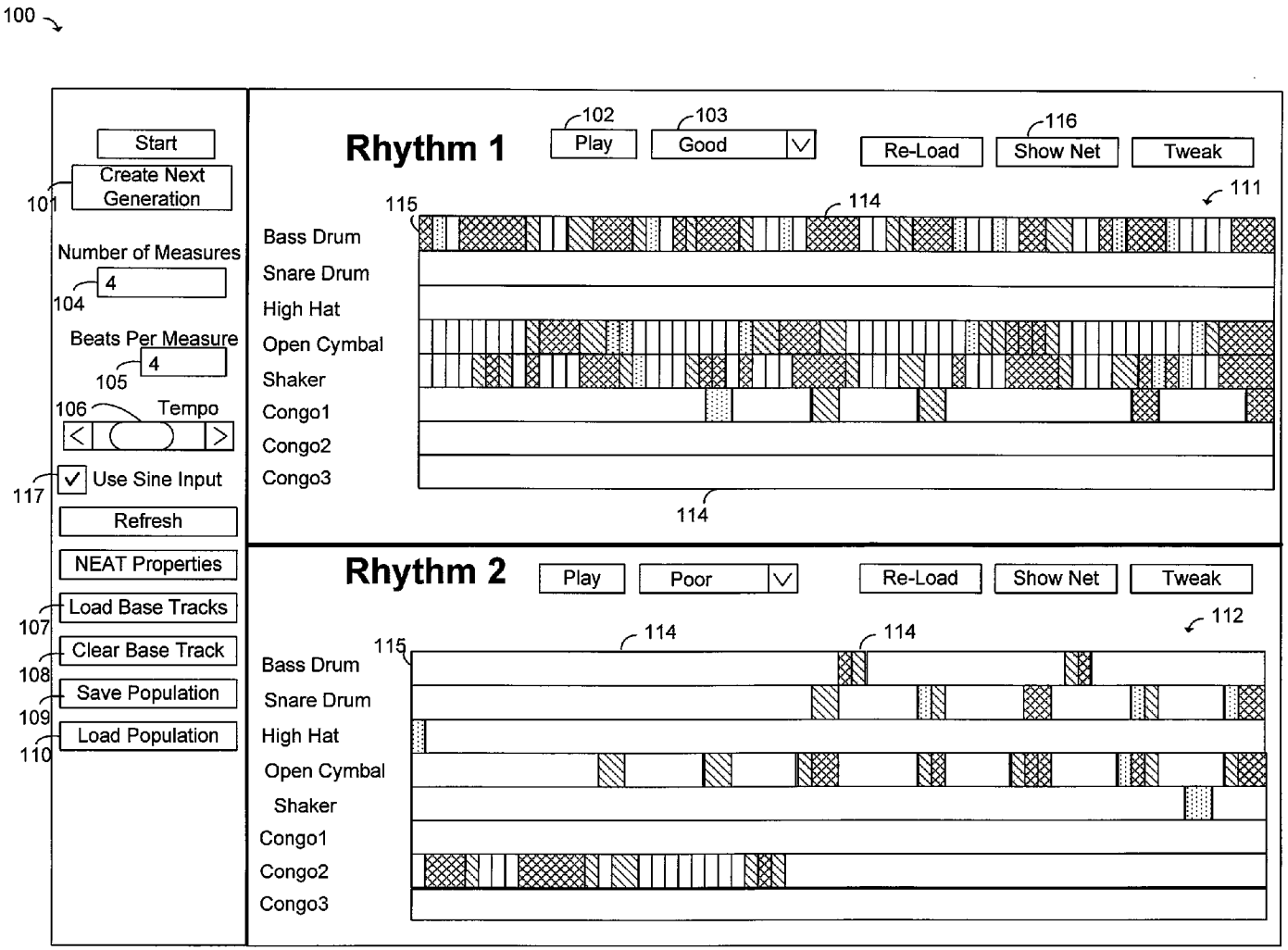
FIG. 3 is an illustration of an example graphical user interface (GUI) allowing a user to select and evolve the CPPNs from FIG. 1.

The time signature inputs for the example CPPN 100' of FIG. 3 are a beat signal 11, a time signal 12, and a measure signal 13 which encode the structure of a musical composition. The beat signal 11, for example, may indicate the number of beats per measure, the time signal 12 may indicate the time signature, and the measure signal 13 may indicate the number of measures for the generated rhythm. These measure, beat, and time inputs are "conductors" which act as temporal patterns or motifs to directly describe the structure of the rhythm as it varies over time. In some embodiments, the user specifies one or more of the input time signature inputs (e.g., 4 beats per measure for 32 measures). In other embodiments, the input time signature inputs as well as the activation functions are generated by rhythm CPPN generation logic 53. As described below, the functions are selected by logic 53 so that the functions vary from one CPPN to another within the generated initial population of CPPNs.

Other inputs may be provided to the CPPN 100'. As an example, a sine wave may be provided as an input that peaks in the middle of each measure of the musical composition, and the CPPN function may be represented as g(m, b, t, s) where "s" is the sine wave input. While many rhythms may result when the sine wave is provided as an additional input, the output produced by the function g(m, b, t, s) exhibits a sine-like symmetry for each measure.

Figure 2B:
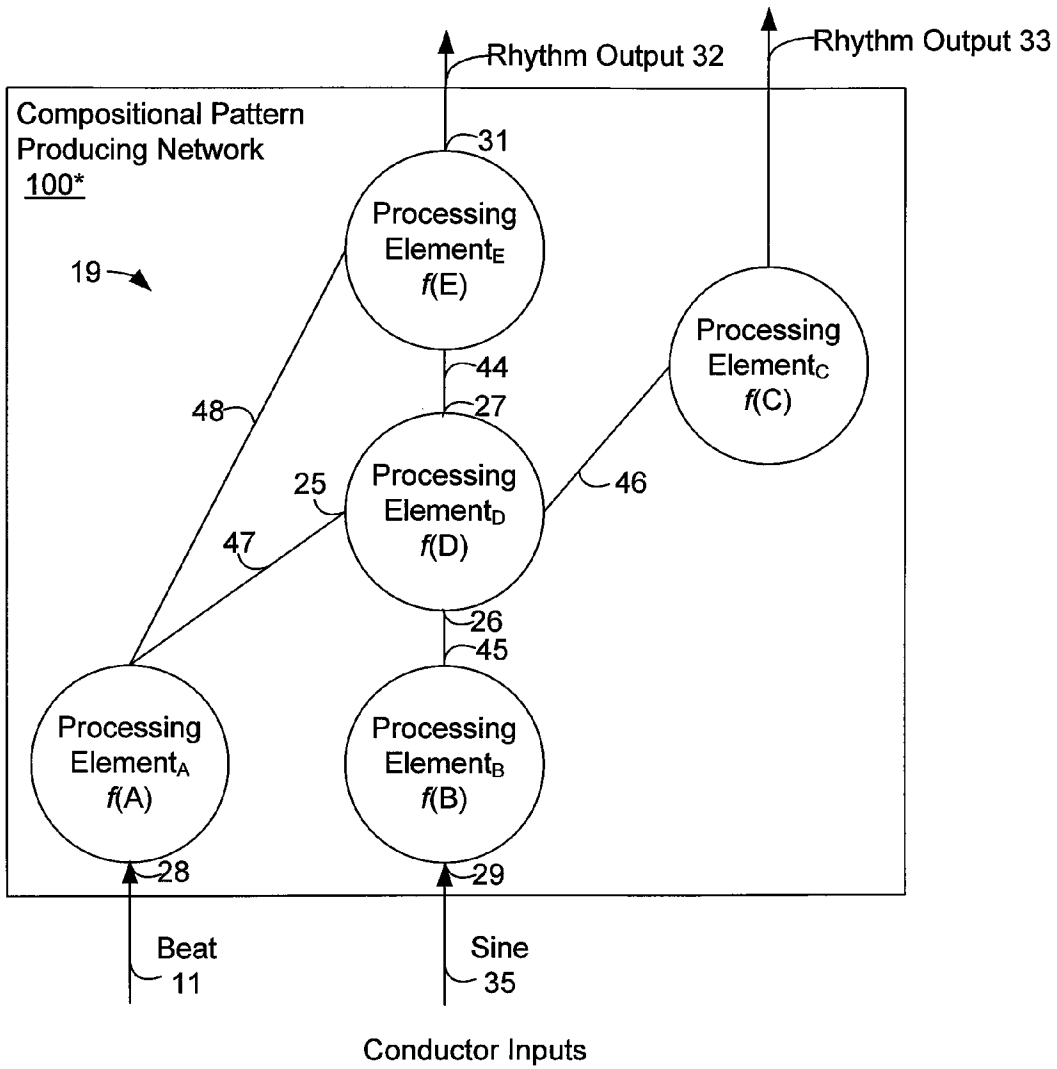

FIG. 2B depicts another example CPPN 100* indicative of the CPPNs 100-110 or CPPNs 200-210. CPPN 100* exhibits an example topology 49 having a plurality of processing elements A-E. CPPN 100* is similar to CPPN 100' shown in FIG. 2A. However, CPPN 100* produces multiple rhythm outputs 32 and 33, and includes two time signature inputs: beat signal 11 and sine signal 35.

To further illustrate the concept of how the CPPNs in FIGS. 2A and 2B generate rhythm outputs, consider the functions f(x) and f(sin(x)). In this regard, the function f(x) will produce an arbitrary pattern based upon the received input x. However, f(sin(x)) will produce a periodic pattern because it is a function of a periodic function, i.e., it varies symmetrically over time. Notably, a musical composition also symmetrically varies over time. For example, the time in measure increases from the start of the measure to the end of the measure then resets to zero for the next measure. Thus, g(m, b, t) will output a function of the musical composition structure, i.e., time in measure and time in beat, and the output will sound like rhythms indicative of the musical composition.

Example activation functions implemented by processing elements A-E include sigmoid, Gaussian, or additive. The combination of processing elements within a CPPN can be viewed as applying the function g(m, b, t) (described above)

to generate a rhythm signal 32 at output 31 in accordance with the inputs 11-13. Note that, unless otherwise specified, each input is multiplied by the weight of the connection over which the input is received. This support for periodic (e.g., sine) and symmetric (e.g., Gaussian) functions distinguishes the CPPN from an ANN.

As an example, f(D) may employ a sigmoid activation function represented by the following mathematical formula:

$$F(D)=2.0*(1.0/(1.0+\exp(-1.0*x))))-1.0 \quad \text{A.1}$$

In such an example, the variable x is represented by the following formula:

x=input 26*weight of connection 45+input 25*weight of connection 47, A.2 as described herein.

As another example, f(D) may employ a Gaussian activation function represented by the following mathematical formula:

$$f(D)=2.5000*((1.0/sqrt(2.0*Pl))*\exp(-0.5*(x*x))) \quad \text{A.3}$$

In such an example, the variable z is also represented by the formula A.2 described herein.

As another example, f(D) may employ a different Gaussian activation function represented by the following mathematical formula:

$$f(D)=(5.0138*(1/sqrt(2*Pl))\exp(-0.5(x*x)))-1$$

In such an example, the variable x is also represented by the formula A.2 described herein.

Numerous activation functions may be employed in each of the plurality of processing elements A-E, including but not limited to an additive function, y=x; an absolute value function, y=|x|; and exponent function, y=exp(x); a negative function y=−1.0*(2*(1.0/(1.0+exp(−1.0*x)))−1); a reverse function, if (value>0) y=2.50000* ((1.0/sqrt(2.0*Pl))**exp(−8.0*(x*x))) else if (value<0) y=−2.5000*((1.0/sqrt(2.0*Pl))*exp(−8.0*(x*x))); sine functions, y=sin((Pl*x)/(2.0*4.0)), y=sin(x*Pl), or y=sin(x*2*Pl); an inverse Gaussian function y==2.5000*((1.0/sqrt(2.0*Pl))*exp(−0.5*(value*value))); a multiply function, wherein instead of adding the connection values, they are multiplied and a sigmoid, e.g., A.1 is applied to the final product.

As an example, processing element D comprises inputs 25 and 26 and output 27. Further, for example purposes, the connection 45 may exhibit a connection strength of "2" and connection 47 may exhibit a connection strength of "1." Note that the "strength" of a connection affects the amplitude or the numeric value of the particular discrete value that is input into the processing element. The function f(D) employed by processing element may be, for example, a summation function, i.e., $$F(D)=\Sigma(\text{Inputs})=1*\text{input}25+2*(\text{input } 26)=\text{output } 27.$$

Note that other functions may be employed by the processing elements A-E, as described herein, and the summation function used herein is for example purposes.

Note that the placement of the processing elements A-E, the activation functions f(A)-f(E), described further herein, of each processing element A-E, and the strength of the connections 44-48 are referred to as the "topology" of the CPPN 100' or CPPN 100*. The strength of the connections 44-48 may be manipulated, as described further herein, during evolution of the CPPN 100' or CPPN 100* to produce the CPPNs 200-210 and/or produce a modified rhythm reflecting one or more of the CPPNs 100-110 mated or mutated. Notably, the strengths of the connections 44-48 may be increased and/or decreased in order to manipulate the output of the CPPN 100'.

As described earlier with reference to FIG. 1, CPPNs 100-110 are generated by CPPN generation logic 53. The rhythm CPPN generation logic 53 randomly parameterizes in the topology 19, for example, ten different and/or varying connection strengths between their processing elements A-E and activation functions, and the connections made between the processing elements A-E may change from one generated CPPN 100-110 to another. Thus, while each of the CPPNs 100-110 receives the same inputs, the audible representation of the output signal 32 differ from one CPPN 100-110 to another.

In one embodiment, the CPPN generation logic 53 generates the initial population of CPPNs 100-110. This initial population may comprise, for example, ten (10) CPPNs having an input processing element and an output processing element. In such an example, each input processing element and output processing element of each CPPN randomly generated employs one of a plurality of activation functions, as described herein, in a different manner. For example, one of the randomly generated CPPNs may employ formula A.1 in its input processing element and A.2 in its output processing element, whereas another randomly generated CPPN in the initial population may employ A.2 in its input processing element and A.1 in its output processing element. In this regard, each CPPN generated for the initial population is structurally diverse.

Further, the connection weight of a connection 44-48 intermediate the processing elements of each CPPN in the initial population may vary as well. As an example, in one randomly generated CPPN the connection weight between the processing element A and B may be "2," whereas in another randomly generated CPPN the connection weight may be "3."

Once the CPPN generation logic 53 generates the initial population, a user may view a graphical representation or listen to the rhythm of each CPPN 100-110 generated. One such graphic representation will be described below in connection with FIG. 3, which illustrates a graphical user interface (GUI) 100. The GUI 100 comprises a plurality of grid representations 111 and 112 that graphically depict a rhythm, e.g., "Rhythm 1" and "Rhythm 2," respectively. Each grid 11 and 112 comprises a plurality of rows 115, each row corresponding to a specific instrument, for example a percussion instrument including but not limited to a "Bass Drum," a "Snare Drum," a "High Hat," an "Open Cymbal," and one or more Congo drums. Each row comprises a plurality of boxes 114 that are arranged sequentially to correspond temporally to the beat in the rhythm.

GUI 100 interprets the rhythm output of one or more CPPNs to visually convey the strength at which each instrument beat is played. In the example of FIG. 3, this information is conveyed by the shading or pattern which fills boxes 114. For example, boxes 114 with a dotted pattern represent the weakest beats, while boxes 114 with a crosshatching pattern represent the strongest beats, and boxes 114 with a (single) hatching pattern represent intermediate beats. Furthermore, the row 115 represents a discrete number of music measures. For example, the row 115 associated with the Bass Drum may be sixteen (16) measures.

By examining the row 115 associated with an instrument, one can evaluate, based upon the visual representation of in the row 115, whether the rhythm for the instrument may or may not be an acceptable one. In addition, the GUI 100 includes a "Play" button 102 associated with each grid. When button 102 is selected, the CPPN activation logic 54 plays the rhythm graphically represented by the particular grid 111. Since each of the grids 111 and 112 is a representation of a particular CPPN's output (100-110 or 200-210), selecting a "Show Net" button 16 results in a diagram of a CPPN representation (e.g., that depicted in FIG. 2) of the rhythm under evaluation.

Once the user evaluates the rhythm by visually evaluating the grid 111 or playing the rhythm, the user can rate the rhythm by selecting a rating. In this example embodiment, ratings are selected through a pull-down button (e.g., poor, fair, or excellent). Other embodiments use other descriptive words or rating systems.

The GUI 100 further includes a "Number of Measures" control 104 and a "Beats Per Measure" control 105. As described herein, the rhythm displayed in grid 100 is a graphical representation of an output of a CPPN (100-110, 200-210) that generates the particular rhythm, where the CPPNs 100-110 and 200-210 further comprise beat, measure, and time inputs 11-13 (FIG. 2). Thus, if the user desires to change particular characteristics of the rhythm, e.g., the beats or the measure via controls 104 and 105, the evolving logic 54 changes the inputs provided to the particular CPPN represented by the grid 111. The beat, measure, and time inputs 11-13 described herein are examples of conductor inputs, and other inputs may be provided in other embodiments to the CPPN 100'. The GUI 100 may be extended to allow modification of any input provided to the CPPN 100'.

Furthermore, the GUI 100 includes a tempo control 106 that one may used to change the tempo of the rhythm graphically represented by grid 111. In the example embodiment of FIG. 3, a user can speed up the rhythm by moving the slide button 106 to the right, or slow the rhythm by moving the slide button to the left.

The GUI 100 further includes a "Load Base Tracks" button 107. A base track plays at the same time as the generated rhythm, allowing the user to determine whether or not a particular generated rhythm is appropriate for use as a rhythm for the base track. Further, one can clear the tracks that are used to govern evolution by selecting the "Clear Base Track" button 108. Once each rhythm is evaluated, the user may then select the "Save Population" button 109 to save those rhythms that are currently loaded, for example, "Rhythm 1" and "Rhythm 2."

Additionally, once one or more rhythms have been selected as good or acceptable as described herein, the user may then select the "Create Next Generation" button 101. The evolving logic 54 then evolves the selected CPPNs 100-110 corresponding to the selected or approved rhythms as described herein. In this regard, the evolving logic 54 may perform speciation, mutate, and/or mate one or more CPPNs 100-110 and generate a new generation of rhythms generated by the generated CPPNs 200-210. The user can continue to generate new generations until satisfied.

The GUI 100 further comprises a "Use Sine Input" selection button 117. If selected, the evolving logic 54 may feed a Sine wave into an CPPN 100-110 or 200-210 as an additional input, for example, to CPPN 100' (FIG. 2). When fed into the CPPN 100', the rhythm produced by the CPPN 100' will exhibit periodic variation based upon the amplitude and frequency of the Sine wave input.

Figure 4:
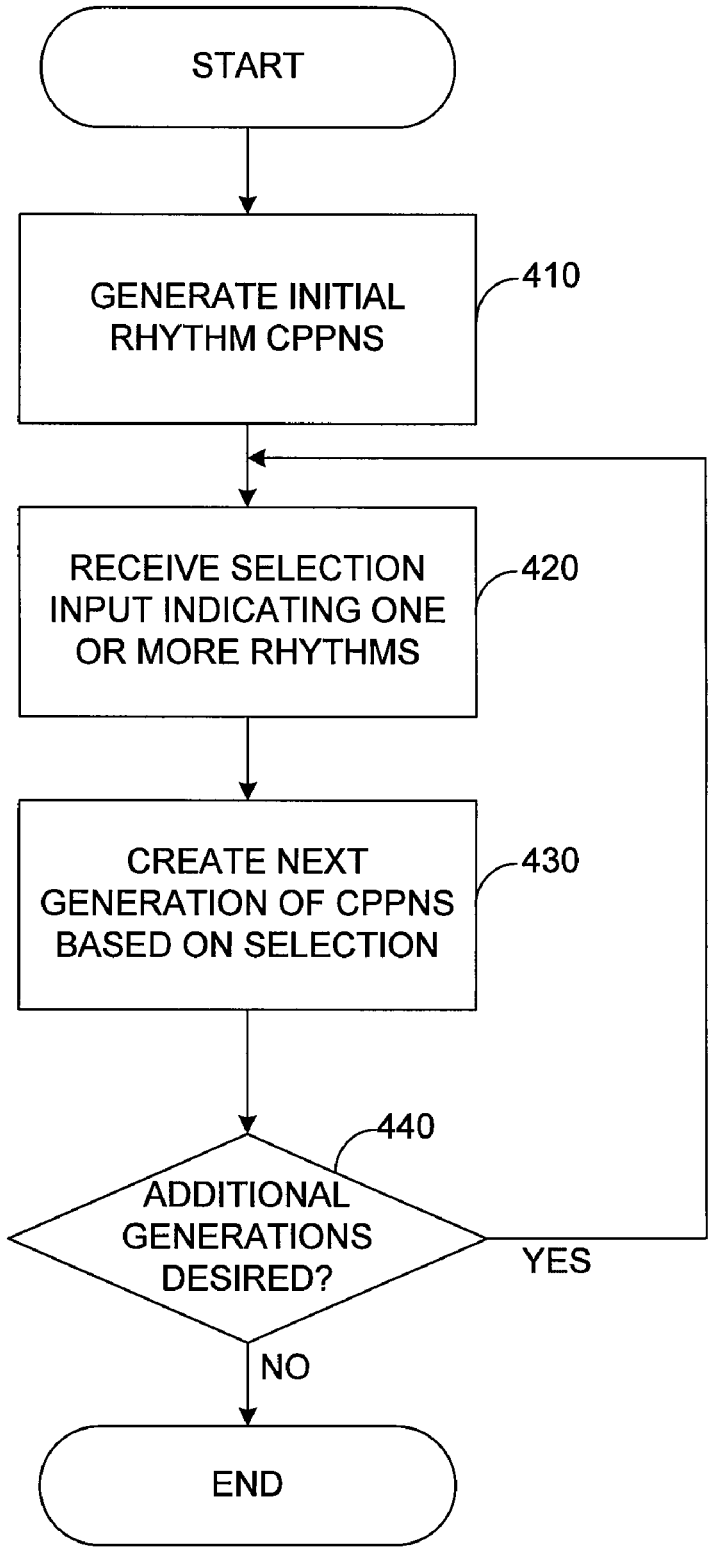
FIG. 4 is a flowchart depicting a method implemented by one embodiment of the system from FIG. 1.

FIG. 4 shows a flowchart implemented by an example system 10 for evolving rhythmic patterns. At step 410, the system 10 generates an initial population of rhythm CPPNs. Each of the rhythm CPPNs produces a signal indicative of a rhythm. In this regard, the CPPNs generated can have a plurality of inputs such as inputs 11-13 (FIG. 2), and the rhythms generated by the CPPNs are based upon those inputs.

Once the CPPNs are generated, the user evaluates the rhythms. In some embodiments, a program interacts with CPPN logic 52 and 53 to obtain a description of the initial population of CPPNs, then produces a visual representation of the CPPNs (e.g., GUIs 300, 500). At step 420, the system 10 receives a user selection of one or more of the rhythms. In some embodiments, user selection includes a user rating each initial rhythm for example, on a scale from excellent to poor.

At step 430, the system 10 creates a next generation of CPPNs based upon the selection input. In this regard, the system 10 generates CPPNs 200-210 through speciation, mutation, and/or mating based upon those rhythms that the user selected and their corresponding CPPNs. At step 440, the system 10 determines whether or not the user desires additional generations of CPPNs to be produced. If Yes, the process repeats again starting at step 420. If No, the process is ended. In this manner, the process of selection and reproduction iterates until the user is satisfied.

The systems and methods for evolving a rhythm disclosed herein can be implemented in software, hardware, or a combination thereof. In some embodiments, such as that shown in FIG. 1, the systems and/or method are implemented in software that is stored in memory 20 and executed by a suitable processor 21 (e.g., a microprocessor, network processor, microcontroller, etc.) residing in a computing device. In other embodiments, the system and/or method is implemented in hardware logic, including, but not limited to, a programmable logic device (PLD), programmable gate array (PGA), field programmable gate array (FPGA), an application-specific integrated circuit (ASIC), a system on chip (SoC), and a system in package (SiP).

The systems and methods disclosed herein can be embodied in any computer-readable medium for use by or in connection with an instruction execution system, apparatus, or device. Such instruction execution systems include any computer-based system, processor-containing system, or other system that can fetch and execute the instructions from the instruction execution system. In the context of this disclosure, a "computer-readable medium" can be any means that can contain or store the program for use by, or in connection with, the instruction execution system. The computer readable medium can be based on, for example but not limited to, electronic, magnetic, optical, electromagnetic, or semiconductor technology.

Specific examples of a computer-readable medium using electronic technology would include (but are not limited to) the following: a random access memory (RAM); a read-only memory (ROM); an erasable programmable read-only memory (EPROM or Flash memory). A specific example using magnetic technology includes (but is not limited to) a floppy diskette or a hard disk. Specific examples using optical technology include (but are not limited to) a compact disc read-only memory (CD-ROM).

The software components illustrated herein are abstractions chosen to illustrate how functionality is partitioned among components in some embodiments disclosed herein. Other divisions of functionality are also possible, and these other possibilities are intended to be within the scope of this disclosure. Furthermore, to the extent that software components are described in terms of specific data structures (e.g., arrays, lists, flags, pointers, collections, etc.), other data structures providing similar functionality can be used instead.

Software components are described herein in terms of code and data, rather than with reference to a particular hardware device executing that code. Furthermore, to the extent that system and methods are described in object-oriented terms, there is no requirement that the systems and methods be implemented in an object-oriented language. Rather, the systems and methods can be implemented in any programming language, and executed on any hardware platform.

Software components referred to herein include executable code that is packaged, for example, as a standalone executable file, a library, a shared library, a loadable module, a driver, or an assembly, as well as interpreted code that is packaged, for example, as a class. In general, the components used by the systems and methods for evolving a rhythm are described herein in terms of code and data, rather than with reference to a particular hardware device executing that code. Furthermore, the systems and methods can be implemented in any programming language, and executed on any hardware platform.

The flow charts, messaging diagrams, state diagrams, and/or data flow diagrams herein provide examples of the operation of rhythm generating CPPN logic, according to embodiments disclosed herein. Alternatively, these diagrams may be viewed as depicting actions of an example of a method implemented by rhythm generating CPPN logic. Blocks in these diagrams represent procedures, functions, modules, or portions of code which include one or more executable instructions for implementing logical functions or steps in the process. Alternate implementations are also included within the scope of the disclosure. In these alternate implementations, functions may be executed out of order from that shown or discussed, including substantially concurrently or in reverse order, depending on the functionality involved.

The foregoing description has been presented for purposes of illustration and description. It is not intended to be exhaustive or to limit the disclosure to the precise forms disclosed. Obvious modifications or variations are possible in light of the above teachings. The implementations discussed, however, were chosen and described to illustrate the principles of the disclosure and its practical application to thereby enable one of ordinary skill in the art to utilize the disclosure in various implementations and with various modifications as are suited to the particular use contemplated. All such modifications and variation are within the scope of the disclosure as determined by the appended claims when interpreted in accordance with the breadth to which they are fairly and legally entitled.

What is claimed is:

1. A method for generating rhythms, comprising the steps of:

generating a first plurality of Compositional Pattern Producing Networks (CPPNs) representing an initial population, wherein each CPPN in the first plurality produces a rhythm in a corresponding plurality of first rhythms;

receiving a selection of one of the plurality of first rhythms; and evolving a a second plurality of CPPNs, representing a next generation, based upon the selection and the initial population representing the initial population, wherein each CPPN in the second plurality produces a rhythm in a corresponding plurality of second rhythms.

2. The method of claim 1, wherein the generating further comprises:

generating each CPPN in the first plurality of CPPNs based on a time signature input.

3. The method of claim 2, wherein at least one of the corresponding plurality of second rhythms represents volume varying over a series of time steps.

4. The method of claim 2, wherein at least one of the corresponding plurality of second rhythms comprises a plurality of tracks, each track associated with an instrument and representing volume of the instrument varying over a series of time steps.

5. The method of claim 2, wherein the time signature input indicates time within a measure of the musical composition.

6. The method of claim 2, wherein the time signature input indicates time within a beat of the musical composition.

7. The method of claim 1, wherein the evolving comprises speciation, mutation, mating, or combinations thereof.

8. The method of claim 1, wherein the selection is a user selection.

9. A system for generating rhythms, comprising:

a plurality of Compositional Pattern Producing Networks (CPPNs), each of the CPPNs using a time signature input to produce a rhythm;

logic configured to receive a selection of one or more of the CPPNs; and logic configured to generate at least one evolved CPPN based upon the selection.

10. The system of claim 9, further comprising:

logic configured to provide a graphical representation of at least one of the rhythms.

11. The system of claim 9, further comprising:

logic configured to provide a graphical representation of at least one of the rhythms based on a description of the rhythm, the description produced by the selected CPPN.

12. The system of claim 9, wherein the rhythm represents volume varying over a series of time steps.

13. The system of claim 9, wherein the time signature input indicates time within a measure of a musical composition.

14. The system of claim 9, wherein the time signature input indicates time within a beat of a musical composition.

15. The system of claim 9, wherein the time signature input indicates time within a musical composition.

16. A computer device for generating rhythms from a plurality of Compositional Pattern Producing Networks (CPPNs) representing an initial population, the computer device comprising:

memory having instructions stored thereon; and a processor configured by the instructions when retrieved by the memory to:

receive a user selection of one or more of the CPPNs; and generate at least one evolved CPPN based upon the selection and the plurality of CPPNs, each of the CPPNs using a time signature input to produce a rhythm.

17. The computer device of claim 16, wherein the rhythm represents volume varying over a series of time steps.

18. The computer device of claim 16, wherein the time signature input indicates time within a musical composition.

19. The computer device of claim 16, wherein the rhythm produced by the at least one evolved CPPN comprises a plurality of tracks, each track associated with an instrument.

20. The computer device of claim 16, wherein the processor is further configured by the instructions to perform the generation of the at least one evolved CPPN using speciation, mutation, mating, or combinations thereof.

* * * * *